US007325762B2

(12) United States Patent
Marbourg

(10) Patent No.: US 7,325,762 B2
(45) Date of Patent: Feb. 5, 2008

(54) PAPER GUIDING CHUTE FOR A PAPER SHREDDER

(76) Inventor: Edgar Marbourg, 437 Hillcrest Rd., San Carlos, CA (US) 94070

( * ) Notice: Subject to any disclaimer, the term of this patent is extended or adjusted under 35 U.S.C. 154(b) by 94 days.

(21) Appl. No.: 11/406,193

(22) Filed: Apr. 18, 2006

(65) Prior Publication Data

US 2007/0241220 A1 Oct. 18, 2007

(51) Int. Cl.
*B02C 18/22* (2006.01)

(52) U.S. Cl. ..... 241/301; 241/224; 241/236; 241/285.3

(58) Field of Classification Search ..... 241/236, 241/100, 224, 285.3, 301
See application file for complete search history.

(56) References Cited

U.S. PATENT DOCUMENTS 3,261,441 A * 7/1966 Mullens ..... 193/33
4,657,192 A * 4/1987 Browning ..... 241/224
5,065,947 A * 11/1991 Farnsworth ..... 241/30
5,330,113 A * 7/1994 Poser et al. ..... 241/74
5,662,280 A 9/1997 Nishio et al.
6,460,790 B1 10/2002 Huang
6,964,386 B2 11/2005 Ho
7,014,133 B2 3/2006 Ho
2005/0274836 A1 12/2005 Chang

* cited by examiner

*Primary Examiner*—Mark Rosenbaum

(57) ABSTRACT

The device consists of a paper guiding part formed by a pair of substantially parallel plates spaced with a slot for guiding the paper and a flange for attachment to the shredder. The paper guiding part of the chute may be hinged to the flange for tilting the guiding part into an inoperative position, when necessary. In order to hold the chute in an operative, i.e. upright position, the device is provided with a support member that is pivotally connected to the rear side of the chute. For holding the chute in the upright position, the free end of the support member bears against a stopper provided on the flange.

11 Claims, 3 Drawing Sheets

PAPER GUIDING CHUTE FOR A PAPER SHREDDER

FIELD OF THE INVENTION

The present invention relates to office equipment, in particular to shredders for use in shredding sheet materials such as paper. Such shredders are used, for example, in offices, banks, and other commercial and industrial establishments to shred confidental documents, to destroy used cheques, and for like purposes.

BACKGROUND OF THE INVENTION

Nowadays paper or document shredders are widely used, and there are many different models of shredders available on the market for different purposes.

Typically, in conventional document shredders disposed documents are inserted into the shredder through a paper inlet slot normally provided at the top of the shredder casing. The disposed paper or documents are drawn, e.g., by friction rollers or by pushing them down in a given direction and are cut into paper strips by a rotating roller or rollers which consist of a plurality of cutting edges.

In most cases the paper shredders do not have any guiding devices for guiding the paper into the paper input slot, and in many cases after insertion of paper items, especially those that have a length significantly longer than the width, the paper bends back and folds, leading to increase in thickness of the inserted package and resulting in jamming.

In order to prevent canting or bending of long paper items or documents, the user has to hold the trailing end of the paper or paper bundle until the it smoothly passes through the inlet slot to the cutting edges. This is inconvenient and requires additional time for shredding.

To eliminate the above problem, some paper shredders are provided with automatic feeders for automatically feeding the paper items or paper documents one by one to the inlet slot of the shredder.

For example, U.S. Pat. No. 5,662,280 issued in 1997 to T. Nishio, et al. discloses a paper feed device mounted to a shredder. The intermittent activation time of paper feeding is adjusted, taking into consideration the distance from the paper feed start position to the paper shredding position of a cutter of the shredder, thereby decreasing the speed of travel from the time the paper sensor detects the leading edge of the paper to the time the paper reaches the paper shredding position, so that operation is switched from intermittent to continuous activation preferably immediately before the leading edge of the paper reaches the cutter. Thus paper feed troubles associated with conventional devices are prevented, due to paper jamming, etc., caused by bending of the paper, etc.

Devices with automatic feeding of paper are expensive and their use is justifiable only in conjunction with industrially used shredders that operate frequently and in a heavy-duty mode.

U.S. Pat. No. 6,460,790 issued in 2002 to L. Huang discloses a frame width adjusting device for paper shredder. The primary objective of this invention is to provide a paper shredder with a frame width adjusting structure for adjusting the radian of the outer end of the frame such that the paper shredder cooperates with the paper strip collecting containers having openings various in width and shape. In addition, the paper shredder can be held securely in place on the paper strip collecting containers.

However, such a device does not have any guide chutes and is intended for use only with such paper items as paper strips or paper documents having a large length-to-width ratio.

SUMMARY OF THE INVENTION

It is an object of the present invention to provide a simple and inexpensive paper guiding chute attachable to a paper shredder. It is another object to provide a paper guide of the aforementioned type that can be tilted to place the chute into an inoperative position without disconnection from the main body of the paper shredder for use of the shredder without the paper guide chute, if necessary.

The device consists of a paper guiding part formed by a pair of substantially parallel plates spaced with a slot for guiding the paper to the inlet slot of the shredder. The upper end of the chute may have a diverging shape to facilitate insertion of the paper, while the lower end has a flange for attaching to the casing of the shredder in a position where the paper guiding slot is aligned with the position of the inlet slot of the shredder. The flange may be attached to the shredder casing by screws or by means of a double-sided adhesive tape. The paper guiding part of the chute may be hinged to the flange for tilting the chute into an inoperative position, when necessary. In order to hold the chute in an operative, i.e. upright position, the device is provided with a support member that is pivotally connected to the rear side of the chute. For holding the chute in the upright position, the free end of the support member bears against a stopper provided on the flange.

DETAILED DESCRIPTION OF THE INVENTION

Figure 1:
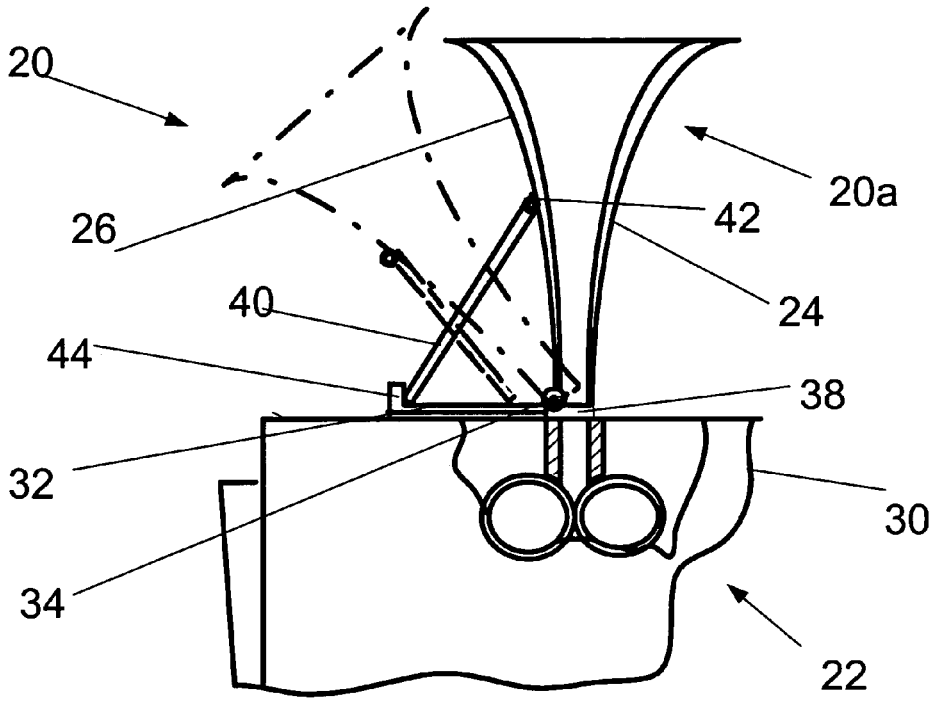
FIG. 1 is a side vertical sectional view of the paper guiding chute of the invention attached to a paper shredder in its operative position.
Figure 2:
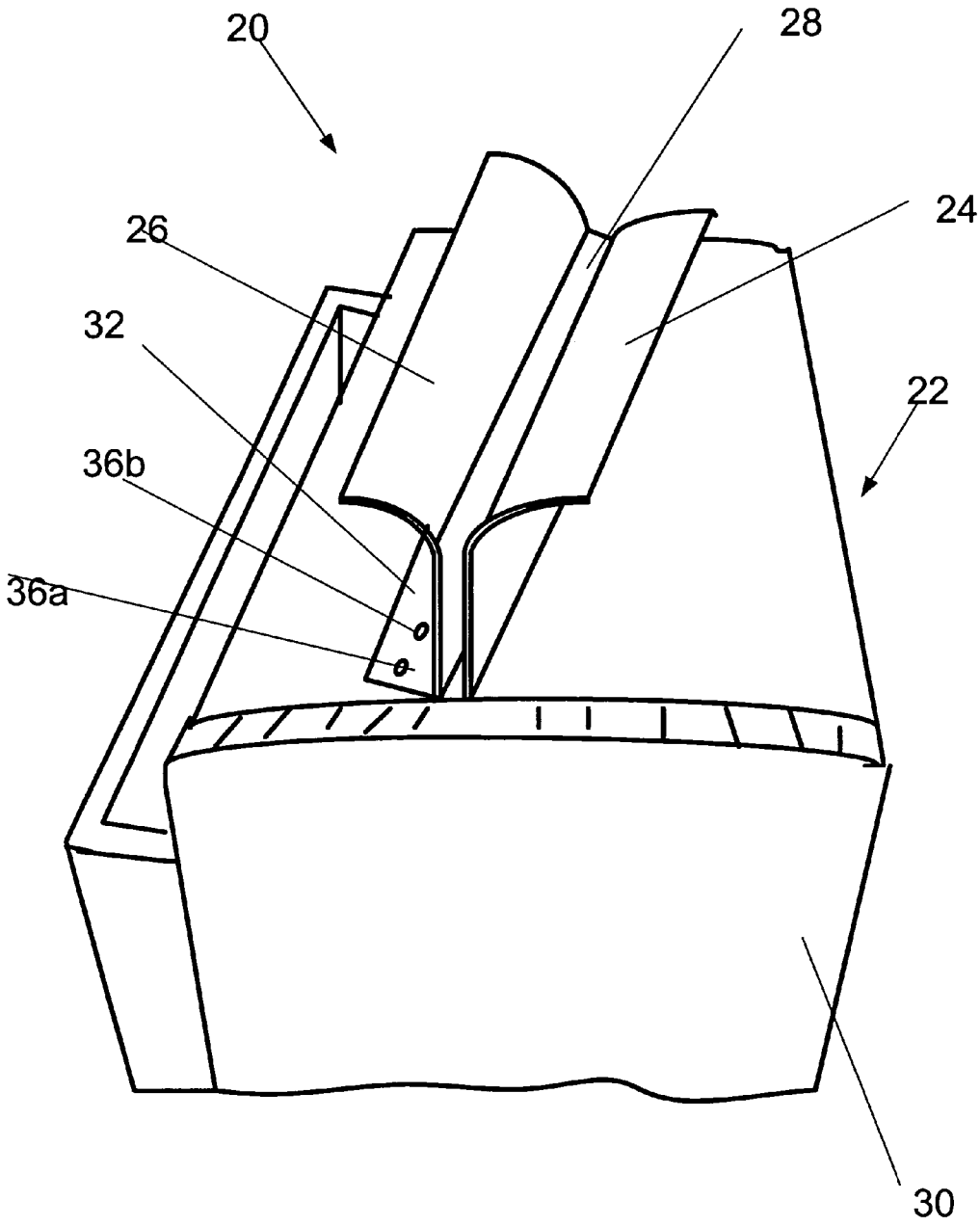
FIG. 2 is a three-dimensional view of the paper guiding chute of FIG. 1 at a certain angle of observation from the top of the shredder.
Figure 3:
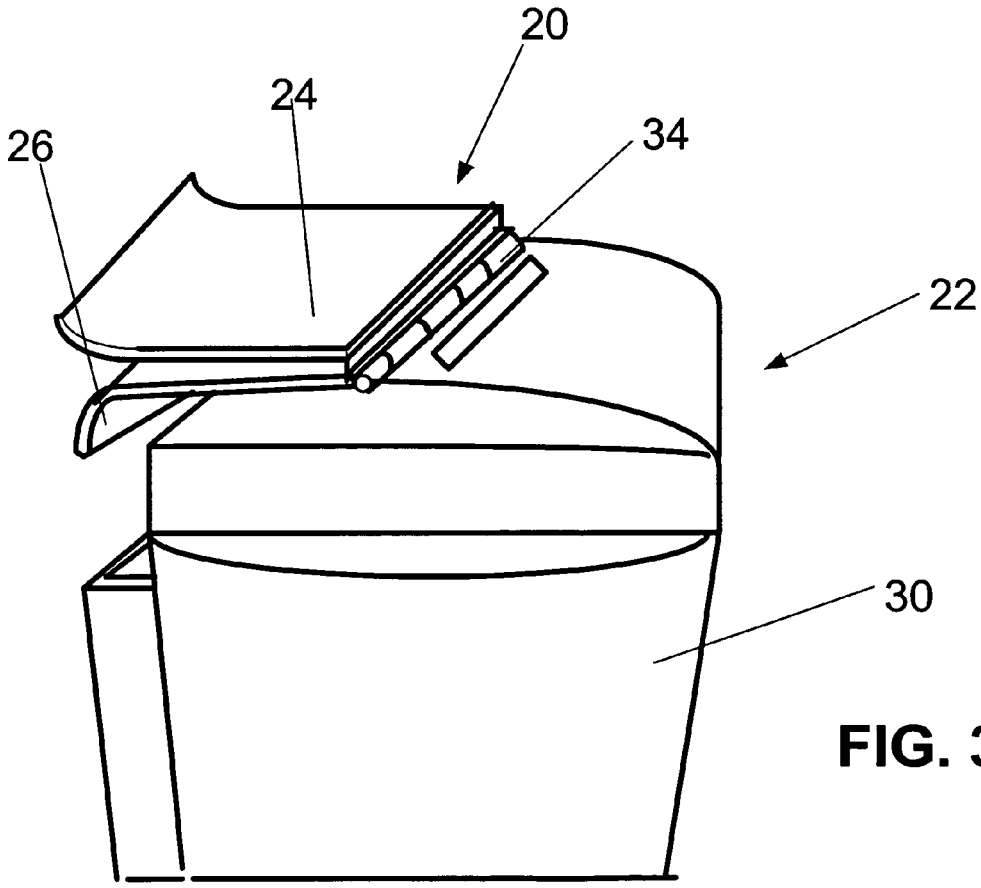
FIG. 3 is a three-dimensional side view of the chute of the invention in a tilted, i.e., inoperative position.

A paper guiding chute of the invention, which as a whole is designated by reference numeral 20, is shown in FIG. 1 that is a side vertical sectional view of the paper guiding chute 20 attached in its operative position to a paper shredder 22. FIG. 2 is a three-dimensional view of the paper guiding chute 20 at a certain angle of observation from the top of the shredder 22. As can be seen from FIGS. 1 and 2, the paper guiding chute 20 consists of two plates 24 and 26, which are spaced from each other to form a paper guiding slot 28. The plates 24 and 26 are substantially parallel to each other at the lower part which is attached to the shredder casing 30 and diverge from each other at the upper part from which the paper document (not shown) is to be inserted into the chute. Such a shape of the paper guiding slot 28 facilitates insertion of the paper document and acts as a finder when the paper is inserted in a skewed direction with respect to the axial direction of the slot 28 defined by the lower parallel ends of the plates 24 and 26. One of the plates, e.g., the plate 26, has a flange 32 that is formed at the lower end face of the chute 20 and is arranged perpendicular to the plate 26. The flange 32 comprises a chute attaching part and is intended for attaching the paper-guiding part 20*a* of the chute 20 formed by the plates 24 and 25 to the casing 30 of the paper shredder 22. The flange 32 can be made integrally with the rest of the chute 20, or may be connected to the latter by hinges 34 for turning the paper guiding chute to an inoperative position, when the use of the chute 20 is not needed. Such hinges are shown in FIG. 3, which is a three-dimensional side view of the chute 20 in a tilted, i.e., inoperative position. Another side view of the chute 20 where it is shown in the inoperative position is FIG. 4.

Figure 4:
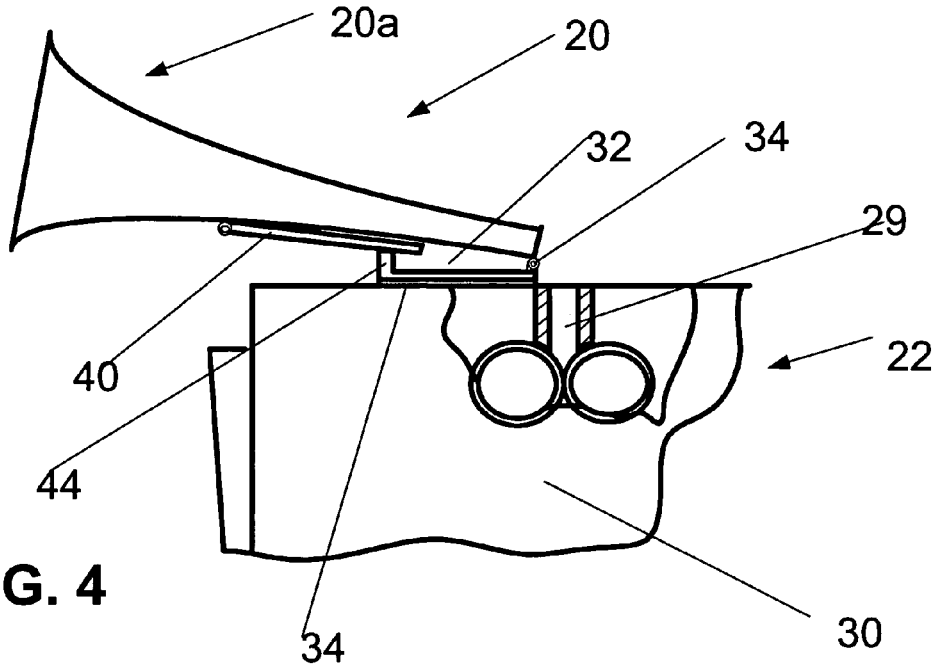
FIG. 4 is another side view of the chute where it is shown in the inoperative position.

The flange 32 can be attached to the casing 30 of the paper shredder by screws 36*a*, 36*b*, . . . 36*n* (FIG. 2) or means of a double-sided adhesive tape 38 (FIGS. 3 and 4). In order to support the hinged part of the chute 20 in an operative, i.e., in the upright position shown in FIGS. 1 and 2, the chute 20 is provided with a pivotal support member 40 which is pivoted to the rear side of the plate 26 on a pivot pin 42. The end of the support member 40 opposite to the pin 42 bears against a stopper projection 44 formed on the flange 32. This is shown in FIG. 1 where images of the chute and of the support member 40 drawn by broken lines illustrate an intermediate position of these parts when the chute 20 is shifted to the inoperative position shown in FIG. 4.

Figure 5:
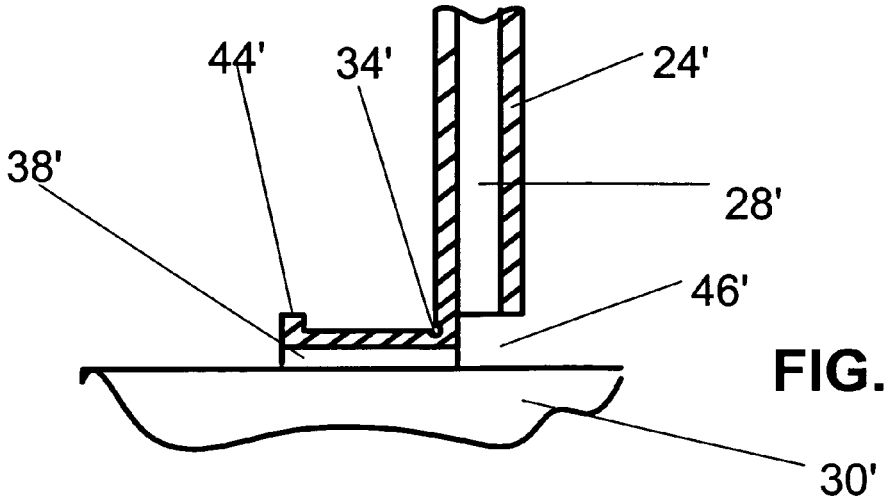
FIG. 5 is a partial view of the paper guiding chute in accordance with another embodiment of the invention.

FIG. 5 illustrates another embodiment of the paper guiding chute 20' of the invention, which is similar to the one shown and described with reference to FIGS. 1 to 4 and differs from it by having a hinge 34' in the form of a thinned portion at the point of intersection between the flange 32' and the plate 26'. The rest of the structure remains unchanged.

It is understood that the chute 20 (22') is attached to the casing 30 (30') in such a position that the paper guiding slot 28 (28') is aligned with the paper inlet slot 29 of the shredder (FIG. 4).

When the chute 20 of the hinged type shown in FIGS. 1 and 2 is needed for guiding documents having the length significantly greater than width, it is installed into the upright position shown in FIG. 1 with the remote end of the supporting member 40 bearing against the stopper projection 44. When the chute is not needed, the chute 20 is slightly inclined forward, which is possible due to a provision of the gap 46 (46') between the lower end of the plate 24 and the upper surface of the casing 30, the end of the supporting member 40 is released from stopper projection 44 (44'), and the chute is tilted to the position shown in FIGS. 3 and 4.

The chute 20 as a whole can be molded from a plastic material or can be made and assembled from metal or from metal and plastic. The paper guide part can be molded as a single piece.

Thus, it has been shown that invention provides a simple and inexpensive paper guiding chute that can be attached to a paper shredder and can be tilted for placing the chute into an inoperative position without disconnection from the main body of the paper shredder for use of the shredder without the paper guide chute, if necessary.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the paper guide chute may have an adjustable width, may be connected to the shredder casing by means other than double-sided adhesive tape or screws, the flange for attachment to the casing may be made on the plate 24 rather than the plate 26. The support member 40 may be adjustable and may have a flat end for attaching to the casing of the shredder by means of an adhesive tape.

The invention claimed is:

1. A paper guiding chute for attaching to a paper shredder having an inlet slot for inserting paper comprising: a paper guiding part having an upper end for inserting a paper and lower end and consisting of two substantially parallel plates spaced from each other with a paper guiding slot formed therebetween; and a chute attaching part arranged perpendicular to the paper guiding slot and formed by a flange connected to said paper guiding part at said lower end, wherein said lower end of said paper guiding part is connected to said flange by a pivotal connection selected from a hinge and a thinned portion of connection between said both parts.

2. The paper guide chute of claim 1, wherein said upper end of said paper guiding part has a diverging shape.

3. The paper guide chute of claim 1, wherein the entire paper guide chute is molded from plastic and wherein said paper guide part is molded as a single piece.

4. The paper guide chute of claim 1, further comprising a support member for supporting said paper guiding part in an upright position on said paper shredder above and in alignment with said inlet slot.

5. The paper guide chute of claim 4, wherein said upper end of said paper guiding part has a diverging shape.

6. The paper guide chute of claim 4, wherein the entire paper guide chute is molded from plastic and wherein said paper guide part is molded as a single piece.

7. The paper guide chute of claim 4, wherein said support member has one end pivotally connected to said paper guiding part and another end which is free.

8. The paper guide chute of claim 7, wherein the entire paper guide chute is molded from plastic and wherein said paper guide part is molded as a single piece.

9. The paper guide chute of claim 7, wherein said flange has a stopper for engagement with said another end of said support member so that said paper guiding part can be switched between said upright position, in which said another end bears against said stopper, and an inoperative position, in which said another end of said support member is freed from said stopper and said paper guiding part is turned to a substantially horizontal position to expose said inlet slot of said paper shredder.

10. The paper guide chute of claim 9, wherein said upper end of said paper guiding part has a diverging shape.

11. The paper guide chute of claim 9, wherein the entire paper guide chute is molded from plastic and wherein said paper guide part is molded as a single piece.

* * * * *